US008715147B2

(12) United States Patent
Collins

(10) Patent No.: US 8,715,147 B2
(45) Date of Patent: May 6, 2014

(54) HANDLE ASSEMBLY WITH COMPRESSIBLE ROTATING GRIP MECHANISM

(76) Inventor: Eugene R. Collins, Silver Spring, MD (US)

( * ) Notice: Subject to any disclaimer, the term of this patent is extended or adjusted under 35 U.S.C. 154(b) by 259 days.

(21) Appl. No.: 13/267,511

(22) Filed: Oct. 6, 2011

(65) Prior Publication Data

US 2013/0090219 A1 Apr. 11, 2013

(51) Int. Cl.
*A63B 21/00* (2006.01)

(52) U.S. Cl.
USPC ..... 482/126; 482/49; 482/97; 482/904

(58) Field of Classification Search
USPC ..... 482/126, 65, 96, 49, 121, 97
See application file for complete search history.

(56) References Cited

U.S. PATENT DOCUMENTS 1,010,796 A * 12/1911 Pons ..... 482/49
1,014,774 A * 1/1912 Rohrer ..... 482/49
1,421,198 A * 6/1922 Fidora ..... 482/126
1,495,278 A * 5/1924 Titus ..... 482/49
1,623,670 A * 4/1927 Frankenfeld ..... 482/123
3,357,702 A * 12/1967 Saders ..... 482/49
3,592,467 A * 7/1971 Pereira ..... 482/126
4,093,211 A 6/1978 Hughes et al.
4,240,624 A 12/1980 Wilson
4,572,503 A 2/1986 Myung Ho
4,729,560 A 3/1988 Cho
4,749,183 A 6/1988 Cho
5,145,473 A 9/1992 Henry
5,776,039 A * 7/1998 Perez, Jr. ..... 482/97
6,086,518 A 7/2000 MacCready, Jr.
6,558,302 B2 5/2003 Cluff
6,565,485 B1 5/2003 Kinsella
7,010,835 B2 3/2006 Tillim
7,473,213 B1 1/2009 Kallenbach
2006/0211552 A1 9/2006 Williams
2010/0113234 A1 5/2010 Kristiansen

* cited by examiner

*Primary Examiner* — Jerome W Donnelly
(74) *Attorney, Agent, or Firm* — Andrew M. Calderon; Roberts Mlotkowski Safran & Cole, P.C.

(57) ABSTRACT

An attachment for exercise equipment is disclosed. The attachment is a handle assembly with a compressible rotating grip mechanism. The grip mechanism includes a swivel grip rotatably attached to the handle, and a floating grip coupled to the swivel grip by one or more pins. The grip mechanism includes one or more springs between the swivel grip and the floating grip.

19 Claims, 15 Drawing Sheets

HANDLE ASSEMBLY WITH COMPRESSIBLE ROTATING GRIP MECHANISM

BACKGROUND OF THE INVENTION

1. Field of the Invention

The present invention relates generally to an attachment for exercise equipment, and more specifically, to a handle assembly with a compressible rotating grip mechanism.

2. Discussion of Background Information

Physical fitness regimens are an important part of any healthy lifestyle. Physical fitness regimens may include, for example, aerobic exercise, strength training, or weight lifting, to name but a few. Strength training, for example, is the use of resistance to build strength, endurance, and increase the size of skeletal muscles. There are many different methods of strength training, the most common being the use of gravity or elastic/hydraulic forces to oppose muscle contraction.

Strength training and weight lifting can be performed using many different types of machines. These machines can include, for example, pulley and cable systems with the use of weights or other resistance based mechanisms. In these types of systems, a handle is often attached to the cable in order to provide a mechanism for the user to conduct his or her workout routine. To this end, there are many different types of handles, each with their own limitations. For example, currently used handle attachments do not provide a mechanism to ensure proper use of the machine, or proper gripping of the handle.

Accordingly, there exists a need in the art to overcome the deficiencies and limitations described hereinabove.

SUMMARY OF THE INVENTION

In a first aspect of the invention, an apparatus comprises a handle and a grip mechanism. The grip mechanism comprises a swivel grip rotatably attached to the handle, and a floating grip coupled to the swivel grip by one or more pins. The grip mechanism includes one or more springs between the swivel grip and the floating grip.

In embodiments, the handle comprises one or more eyelets. The swivel grip is coupled to the handle by a removable connecting mechanism through a longitudinal bore of the swivel grip, wherein the grip mechanism is removable from the handle. One or more of the pins are integral to the swivel grip. The apparatus further comprises one or more springs surrounding the one or more pins. The one or more springs separate the floating grip from the swivel grip. The swivel grip and floating grip comprise one or more recesses for accommodating the one or more springs. The floating grip comprises one or more cavities that are structured to accommodate a pin head of each of the one or more pins. The one or more cavities comprises one or more cavity projections structured to accommodate one or more pin head projections, thereby creating lips within the floating grip which prevent the one or more pins from escaping the one or more cavities when the grip mechanism is in a non-compressed state. The one or more pin heads comprises the one or more pin head projections for communicating with the cavity projections. The one or more pins comprises one or more tapered projections structured to create a clicking noise when in contact with cavity clicking projections or indentations. The one or more cavities comprises the one or more cavity clicking projections or indentations structured to create a clicking noise when in contact with the tapered projections.

In another aspect of the invention, the apparatus comprises a handle comprising one or more eyelets and a grip mechanism. The grip mechanism comprises a swivel grip rotatably attached to the handle. The swivel grip comprises: one or more recesses for accommodating one or more springs; and one or more pins integral to the swivel grip. The grip mechanism also comprises a floating grip coupled to the swivel grip by the one or more pins. The floating grip comprises one or more recesses for accommodating the one or more springs. The grip mechanism also comprises the one or more springs between the swivel grip and the floating grip, surrounding the one or more pins and seated within a respective recess of the one or more recesses of the swivel grip and the floating grip.

In yet another aspect of the invention, an apparatus comprises a handle comprising one or more eyelets, and a grip mechanism. The grip mechanism comprises a swivel grip rotatably attached to the handle. The swivel grip comprises: one or more recesses for accommodating one or more springs; and one or more pins integral to the swivel grip, wherein one or more pin heads comprises one or more pin head projections for communicating with cavity projections, the one or more pins comprising one or more tapered projections structured to create a clicking noise when in contact with cavity clicking projections or indentations. The grip mechanism also comprises a floating grip coupled to the swivel grip by the one or more pins. The floating grip comprises: one or more recesses for accommodating the one or more springs; and one or more cavities that are structured to accommodate a pin head of each of the one or more pins, wherein the one or more cavities comprises one or more cavity projections structured to accommodate the one or more pin head projections, thereby creating lips within the floating grip which prevent the one or more pins from escaping the one or more cavities when the grip mechanism is in a non-compressed state, the one or more cavities comprising one or more of the cavity clicking projections or indentations structured to create a clicking noise when in contact with the tapered projections. The grip mechanism also comprises the one or more springs between the swivel grip and the floating grip, surrounding the one or more pins and seated within a respective recess of the one or more recesses of the swivel grip and the floating grip.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF EMBODIMENTS OF THE INVENTION

The present invention relates generally to an attachment for exercise equipment, and more specifically, to a handle assembly with a compressible rotating grip mechanism. In embodiments, the compressible rotating grip mechanism can be compressed by a user during certain stages of exercise and released during other stages of exercise. The compressible rotating grip mechanism can be compressed and released during rotation from and at multiple angles to the resisting push/pull force caused by the weight being lifted. The present invention advantageously increases vascular circulation in order to stimulate muscle growth by ensuring maximum gripping of the machine, thereby causing maximum contraction of all of the muscles involved with lifting the weight. The invention further requires the user to concentrate on compressing the grip mechanism, and in doing so, causes the user to focus on the muscle group(s) being trained during an exercise routine. The present invention will further stimulate muscle growth as the compressible rotating grip mechanism will cause muscle confusion, and, as a result, the muscles will grow in order to adapt to a new set of constraints. Moreover, the handle assembly allows attachment to a cable from multiple directions of the grip mechanism. This provides added flexibility to the apparatus of the present invention.

In embodiments, the handle assembly can be attached to a cable or cable attachment of any cable based exercise machine. In use, the grip can be squeezed and released due to resistance springs within the grip. The grip assembly also includes a mechanism to alert the user that maximum grip on the assembly has been achieved or lost. For example, when the grip is fully squeezed, a click noise will notify the user of a maximum grip on the handle. The handle can also be attached to the cable in multiple locations through one or more eyelets.

Figure 1A:
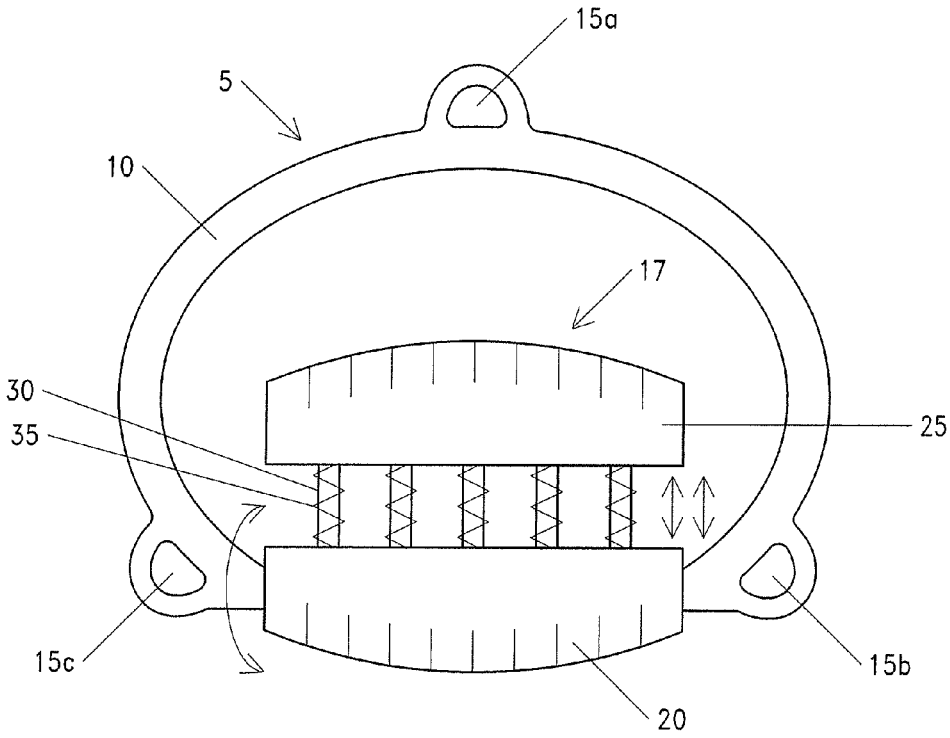
FIG. 1A shows a front view of the handle assembly with the grip mechanism in a released (non-compressed) state according to aspects of the invention.

FIG. 1A shows a front view of the handle assembly 5 with the grip mechanism 17 in a released (non-compressed) state according to aspects of the invention. More specifically, FIG. 1A shows a handle assembly 5 having a handle 10 with eyelets 15*a*, 15*b* and 15*c*. It should be understood by those of skill in the art that one or more eyelets are contemplated by the present invention, with the eyelets being provided at other locations of the handle assembly. In embodiments, the eyelets provide a mechanism to attach the handle assembly 5 to a cable of an exercise machine. It should be understood that the handle assembly 5 can thus be attached in different directions of the handle assembly using the different eyelets 15*a*, 15*b* and 15*c*, thereby allowing the user to train different muscle groups within the same exercise or on the same exercise machine.

As further shown in FIG. 1A, in embodiments, the handle assembly 5 includes a grip mechanism 17. The grip mechanism 17 is rotatable around the handle 10. In embodiments, the grip mechanism 17 includes a swivel grip 20 and a floating grip 25 attached to each other by one or more pins 30 and respective springs 35. The swivel grip 20 is coupled to the handle 10 between the eyelet 15*b* and the eyelet 15*c*; although other positions are also contemplated by the present invention. The swivel grip 20 is configured to rotate around the handle 10 as shown, e.g. in FIG. 3.

In embodiments, the one or more pins 30 can be integral to the swivel grip 20, or can be removably attached to the swivel grip 20. In embodiments, the respective springs 35 provide resistance when compressing the grip mechanism 17. Also, the one or more springs 35 may provide varying resistance by utilizing springs with different spring constants. This provides a user with the ability to adjust the amount of force necessary to compress the grip mechanism 17 in accordance with their physical strength.

Figure 1B:
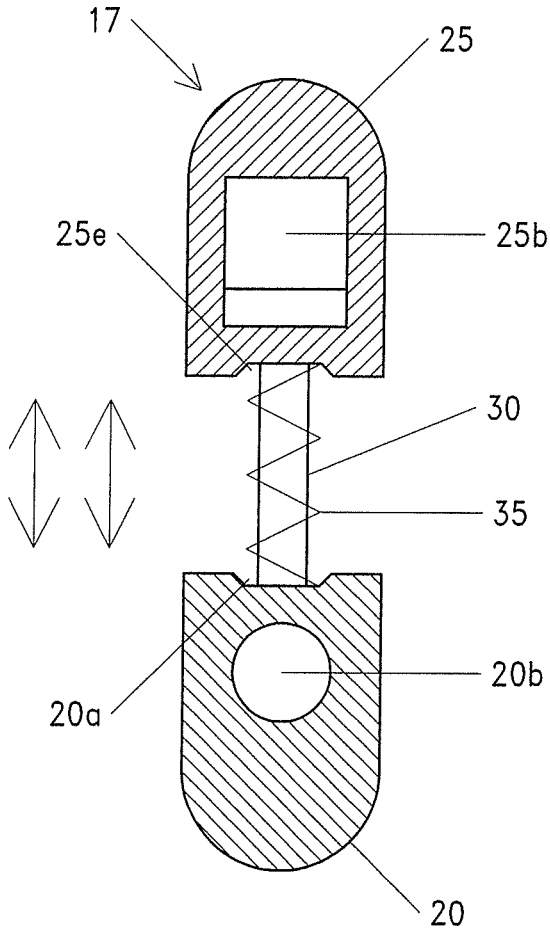
FIG. 1B shows a cross-sectional view of the grip mechanism in the released (non-compressed) state according to aspects of the invention.

FIG. 1B shows a cross-sectional view of the grip mechanism 17 in the released (non-compressed) state according to aspects of the invention. In this state, the floating grip 25 is fully extended, away from the swivel grip 20, by the force of the spring 35. In embodiments, the pin 30 is fixed to the swivel grip 20 and inserted in the floating grip 25 as further discussed below. In alternate embodiments, the one or more pins 30 may be removably attached to the swivel grip 20.

As further shown in FIG. 1B, the one or more springs 35 extend between the swivel grip 20 and the floating grip 25. In embodiments, the spring 35 forces the swivel grip 20 and the floating grip 25 apart, and provides resistance to the users during exercise and, more particularly, during compression of the grip mechanism 17. The springs 35 sit within recesses 25*e* of the floating grip 25 and recesses 20*a* of the swivel grip 20. The pins 30, on the other hand, can extend to within a cavity 25*b* of the floating grip 25. The cavity 25*b* of the floating grip 25 also limits the movement of the pins 30 and, hence, limits the movement of the floating grip 25.

FIG. 1B further shows a longitudinal bore 20*b* of the swivel grip 20. The center of the longitudinal bore 20*b* serves as the axis of rotation for the grip mechanism 17, which couples the swivel grip 20 to the handle 10.

Figure 2A:
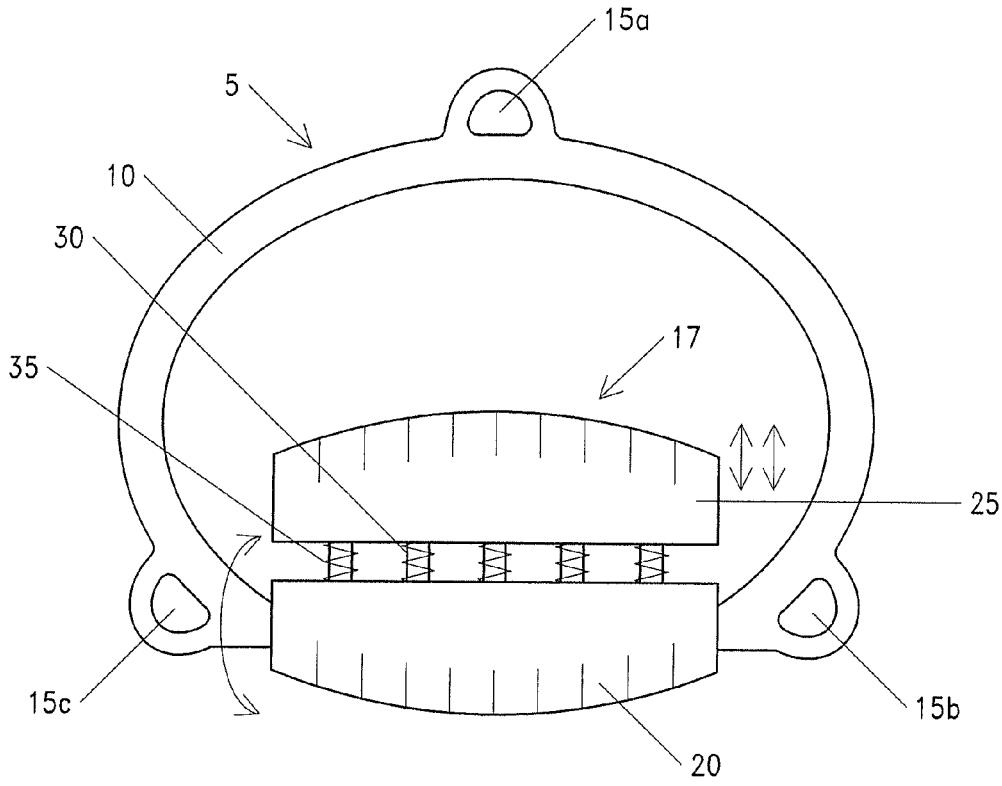
FIG. 2A shows a front view of the handle assembly with the grip mechanism in a compressed state according to aspects of the invention.

FIG. 2A shows a front view of the handle assembly 5 with the grip mechanism 17 in a compressed state according to aspects of the invention. In this state, the floating grip 25 is proximate to the swivel grip 20. This can be accomplished by the one or more pins 30 sliding into the cavities 25*b* of the floating grip 25, while the springs 35 are compressed.

Figure 2B:
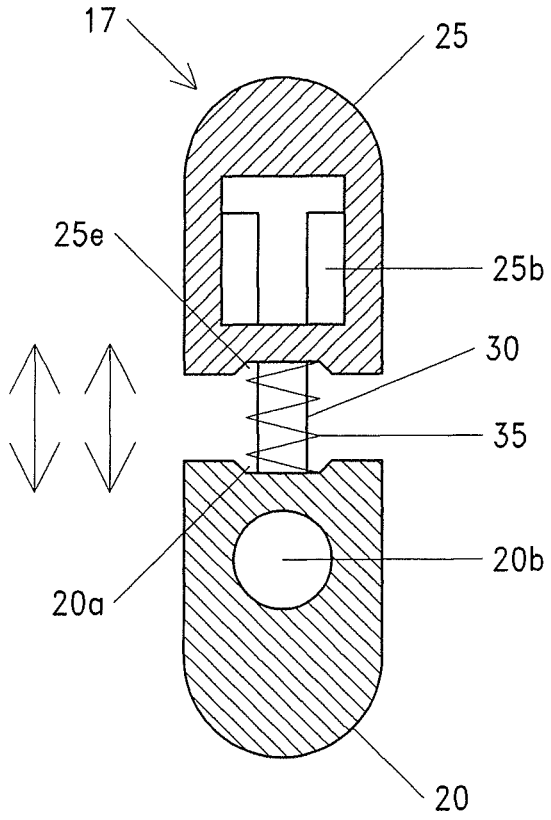
FIG. 2B shows a cross-sectional view of the grip mechanism in a compressed state according to aspects of the invention.

FIG. 2B shows a cross-sectional view of the grip mechanism 17 in a compressed state according to aspects of the invention. In this state, the one or more pins 30 are moved further into the cavities 25*b* of the floating grip 25. As further shown, the springs 35 are compressed between the recesses 20*a* and 25*e*. The compression of the springs 35 provides a resistive force to the user during exercise.

Figure 3:
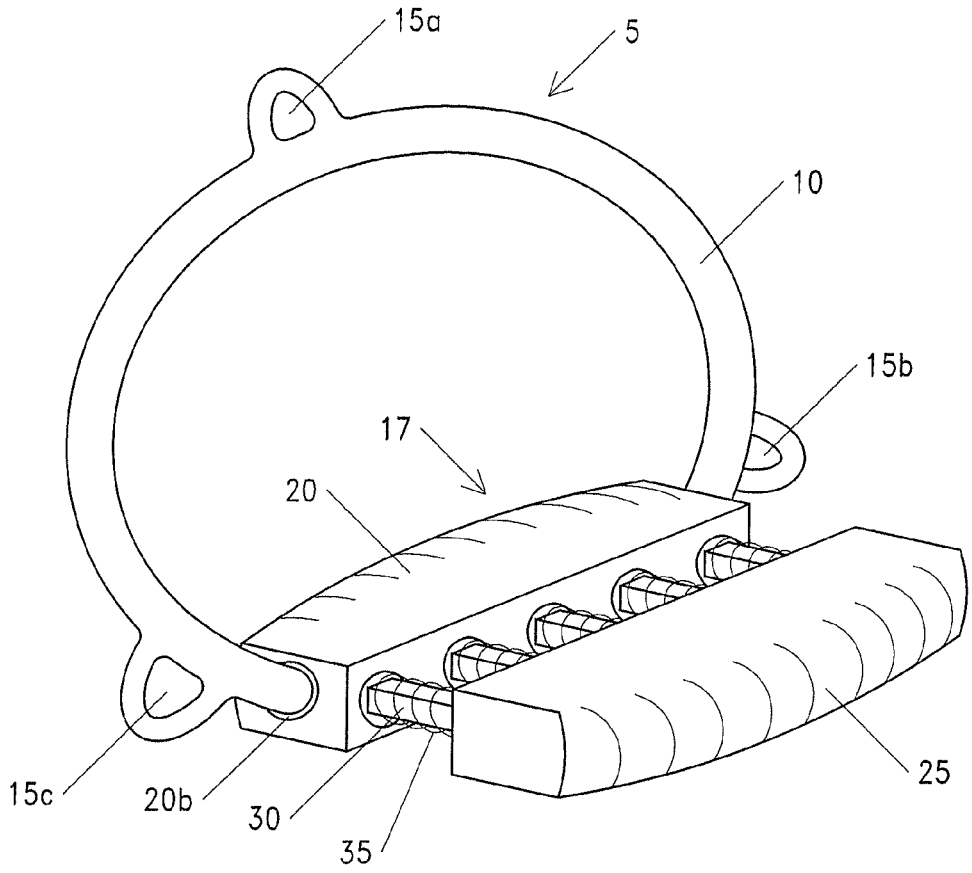
FIG. 3 shows an isometric view of the handle assembly with the grip mechanism in a rotated position according to aspects of the invention.

FIG. 3 shows an isometric view of the handle assembly 5 with the grip mechanism 17 in a rotated position according to aspects of the invention. More specifically, FIG. 3 shows the grip mechanism 17 rotated along an axis of the longitudinal bore 20*b*. In this exemplary representation, the grip mechanism 17 extends outward from the handle 10; although it should be understood that the grip mechanism 17 may be rotated 360 degrees around the handle 10, which permits the user to utilize the handle assembly 5 in multiple directions and angles. This rotation, in turn, maximizes the number of exercises that can be performed with a single handle assembly and allows maximum grip to be achieved from multiple angles and during rotation.

Figure 4:
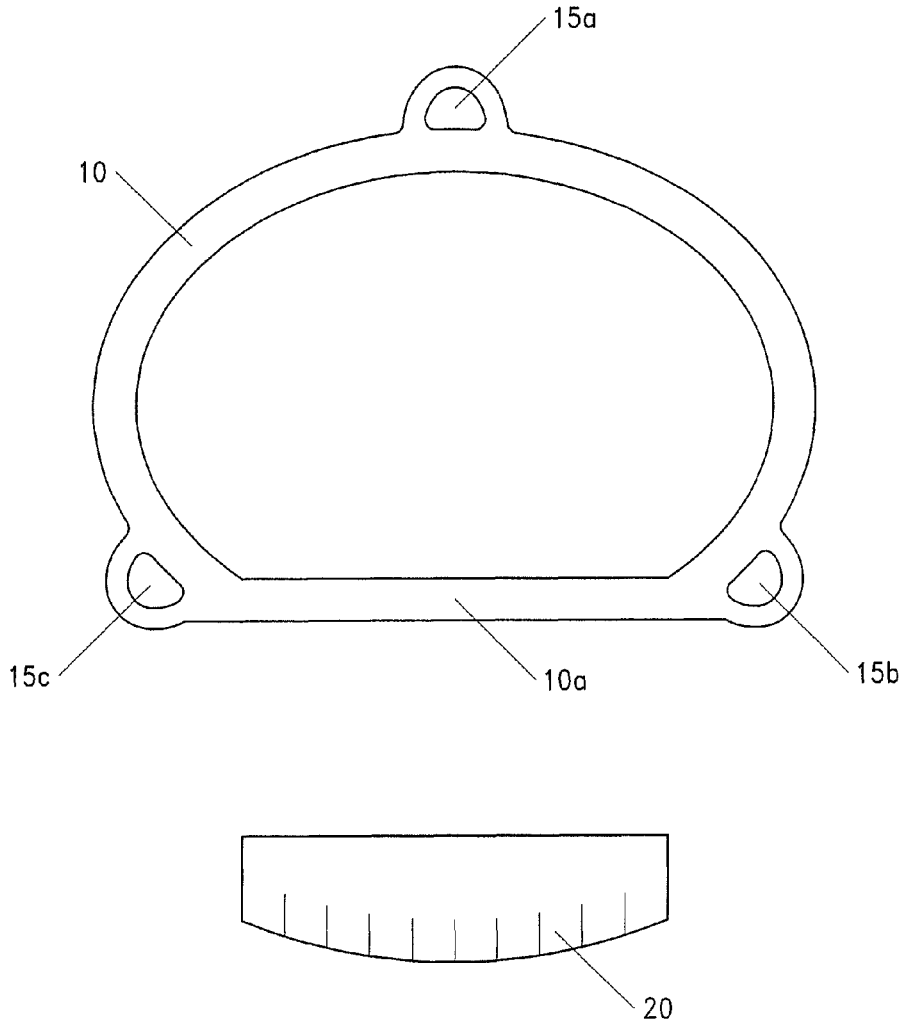
FIG. 4 shows an exploded front view of the handle and the swivel grip according to aspects of the invention.

FIG. 4 shows an exploded front view of the handle 10 and the swivel grip 20 according to aspects of the invention. In particular, the handle 10 of FIG. 4 is unitary, which may be composed of a wide array of materials. These materials may include, for example, steel, plastic, metal alloys, or other known materials that can be used for handles. Similarly, the swivel grip 20 may be composed of various materials such as plastic but may also be made of any type of other suitable material that can be used for the swivel grip such as, for example, a metal or metal alloy. The swivel grip 20 is ergonomically designed in order for the user to easily grasp the swivel grip 20. In the embodiment of FIG. 4, the handle portion 10*a* between the eyelets 15*b* and 15*c* is configured to accommodate connection or coupling with the swivel grip 20.

Figure 5:
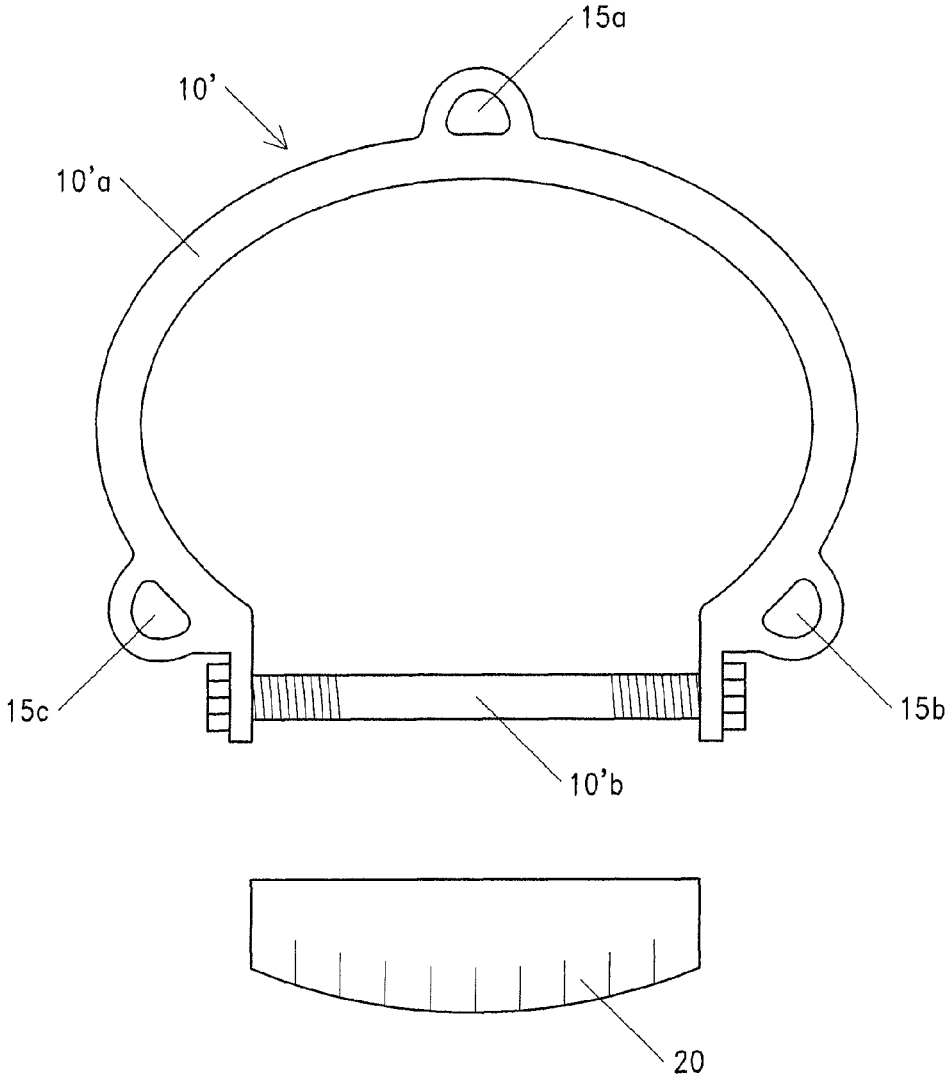
FIG. 5 shows an exploded front view of an alternate handle and swivel grip according to aspects of the invention.

In an alternate embodiment, FIG. 5 shows an exploded front view of the handle 10' and the swivel grip 20 according to aspects of the invention. In this embodiment, the handle 10' includes a first portion 10'*a* comprising the eyelets, and an attachment portion 10'*b*. The attachment portion 10'*b* is preferably an attachment mechanism such as a bolt extending between two ends of the first portion 10'*a*. The attachment may be made through a threaded mechanism, cotter pin mechanism, or other such mechanism. In this embodiment, the swivel grip 20 is attached to the handle 10' by inserting the attachment mechanism 10'*b* through the longitudinal bore 20*b* of the swivel grip 20 and fastening the attachment portion 10'*b* to the first portion 10'*a*. In this way, the grip mechanism 17 can be removed from the handle and replaced with other grip mechanisms with different resistive forces. Also the grip mechanism 17 can be used as a stand-alone apparatus, as with the embodiment shown in FIG. 4.

Figure 6:
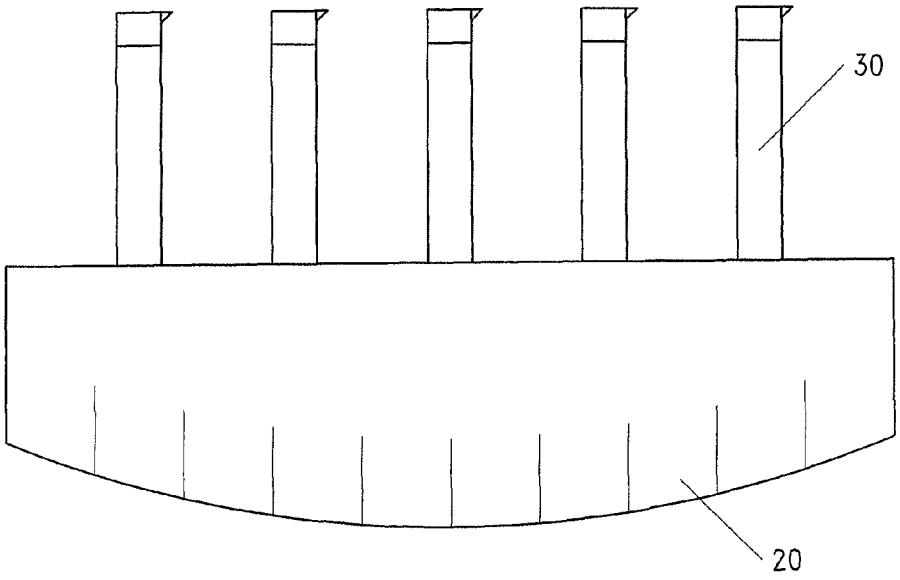
FIG. 6 shows a front view of the swivel grip with one or more pins affixed thereto according to aspects of the invention.

FIG. 6 shows a front view of the swivel grip 20 with one or more pins 30 affixed thereto according to aspects of the invention. More particularly, FIG. 6 shows the one or more pins 30 integrally formed with the swivel grip 20. Although five pins are shown in FIG. 6, it should be understood that more or less pins are also contemplated by the present invention. The pins 30 may be composed of a wide array of materials. These materials may include, for example, steel, plastic, metal alloys, or other known materials that can be used for pins.

Figure 7:
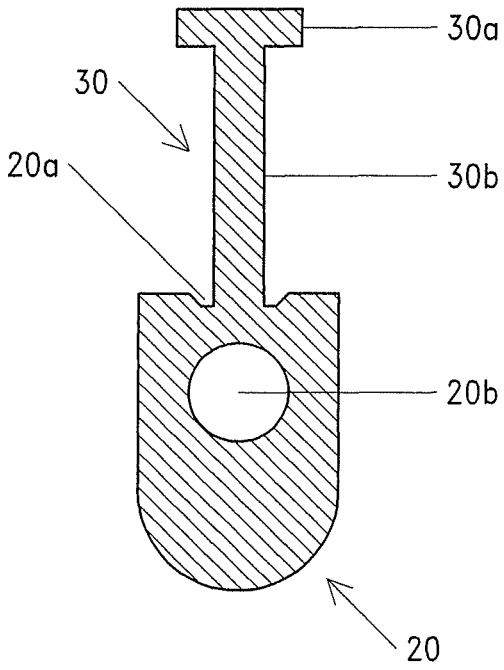
FIG. 7 shows a cross-sectional view of the swivel grip and pin according to aspects of the invention.

FIG. 7 shows a cross-sectional view of the swivel grip 20 and pin 30 according to aspects of the invention. The cross-sectional view shows the recess 20*a* for receiving the spring 35 and the longitudinal bore 20*b* of the swivel grip 20. Additionally, FIG. 7 shows the pin head 30*a* and the pin shaft 30*b* of the pin 30. In embodiments, the pin head 30*a* can be T-shaped or circular; although, other embodiments are also contemplated by the present invention as described below. Likewise, the pin shaft 30*b* cross-section can be square or circular; although other shapes are also contemplated by the present invention.

Figure 8:
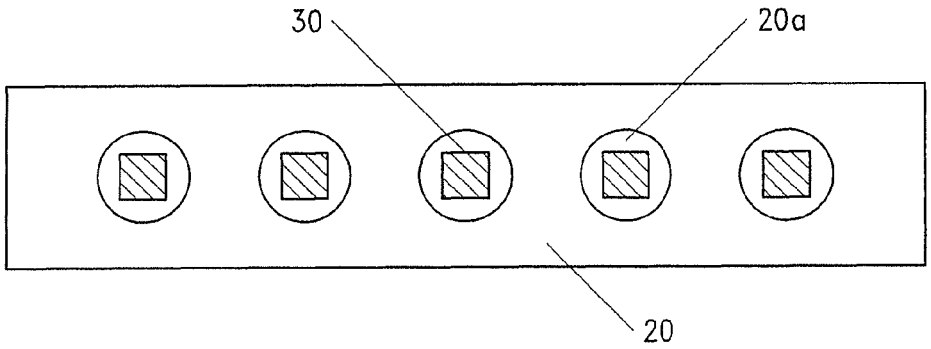
FIG. 8 shows a top view (cut below the pin projections) of the swivel grip with one or more pins affixed thereto according to aspects of the invention.

FIG. 8 shows a top view (cut below the pin projections) of the swivel grip 20 with one or more pins 30 affixed thereto according to aspects of the invention. The top view shows the recesses 20*a* for receiving the springs 35. The top view also shows the pins 30. In embodiments, the recesses 20*a* completely surround the pins 30, and can be circular in shape; although other shapes are also contemplated by the present invention.

Figure 9A:
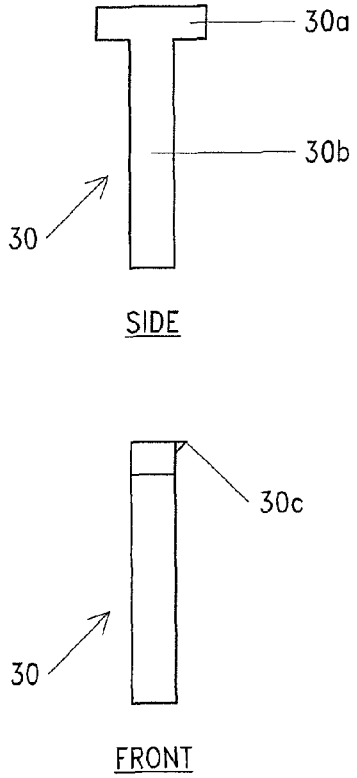
FIG. 9A shows a side view and a front view of a pin according to aspects of the invention.

FIG. 9A shows a side view and a front view of a pin 30 according to aspects of the invention. In particular, the pin 30 includes a pin head 30*a*, a pin shaft 30*b* and a projecting tip 30*c*. The pin head 30*a* can be, for example, T-shaped; although other shapes are also contemplated by the present invention. The projecting tip 30*c* is an extruding portion extending outward from the pin 30, in order to make contact with a cavity projection 25*c* of the floating grip 25. As discussed further below, the contact between the projecting tip 30*c* and the cavity projection 25*c* will result in a clicking noise which signifies the grip mechanism 17 is in a fully compressed state or a released or semi-released state, during usage.

Figure 9B:
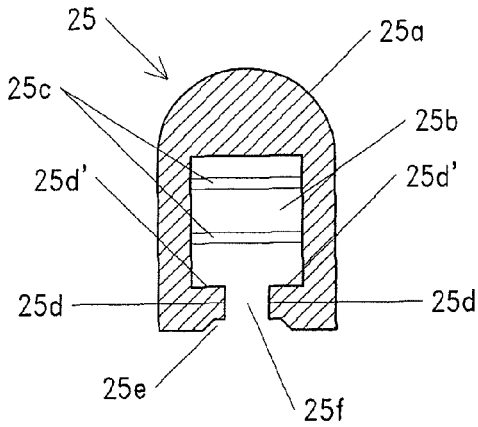
FIG. 9B shows a cross-sectional view (at the pin location) of the floating grip used with the pin of FIG. 9A according to aspects of the invention.

FIG. 9B shows a cross-sectional view (at the pin 30 location) of the floating grip 25 used with the pin 30 of FIG. 9A according to aspects of the invention. The floating grip 25 includes a floating grip body 25*a* and a cavity 25*b* for receiving the pin 30. The cavity 25*b* includes one or more cavity projections 25*c* which communicate with the projecting tip 30*c*. The floating grip body 25*a* further includes a lip 25*d* with a lip surface 25*d'*. The lip surface 25*d'* acts as a rest or stop for the pin head 30*a* when the grip mechanism 17 is in a released state. The floating grip body 25*a* also includes an opening 25*f* for accommodating the pin shaft 30*b*. The opening 25*f* is surrounded by the recess 25*e* which accommodates the spring 35.

In use, as the pin head 30*a* slides within the cavity 25*b*, the projecting tip 30*c* contacts the cavity projection 25*c* causing a clicking sound. This clicking sound will notify the user that the grip mechanism 17 has been properly or fully compressed. Upon release, the projecting tip 30*c* will again contact the cavity projection 25*c* causing a clicking sound. The clicking sound, during the release, signifies that the grip mechanism 17 is not fully compressed or is in a semi or fully released state. The lip 25*d* will prevent the pin 30 from sliding out of the floating grip 25 when the grip mechanism 17 is released. In this state, the pin head 30*a* rests on top of the surface of the lip surface 25*d'*.

Figure 10:
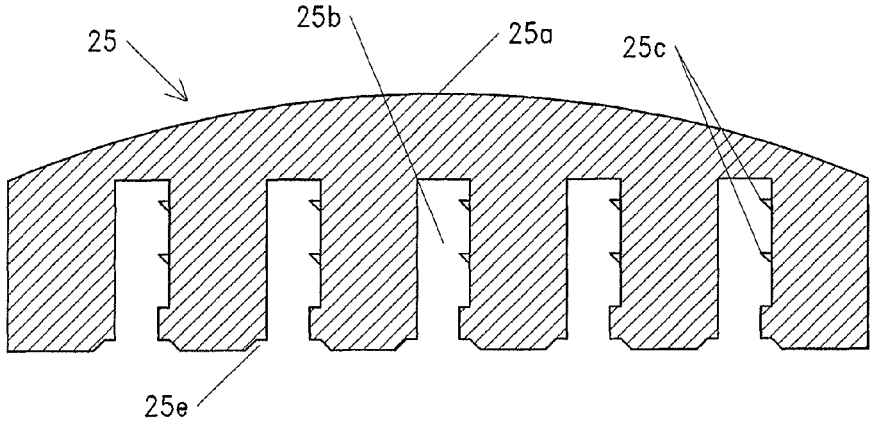
FIG. 10 shows a longitudinal cross-sectional view of the floating grip according to aspects of the invention.

FIG. 10 shows a longitudinal cross-sectional view of the floating grip 25 according to aspects of the invention. More specifically, the longitudinal cross-sectional view shows the floating grip body 25*a* and the cavities 25*b* for receiving the pins 30. Additionally, FIG. 10 shows the cavity projections 25*c* which communicate with the projecting pin tips 30*c*. The longitudinal cross-sectional view also shows the recesses 25*e* for receiving the springs 35. The floating grip 25 may be composed of various materials such as plastic but may also be made of any type of other suitable material that can be used for the floating grip such as, for example, a metal or metal alloy. The floating grip 25 is ergonomically designed in order for the user to easily grasp the floating grip 25.

Figure 11:
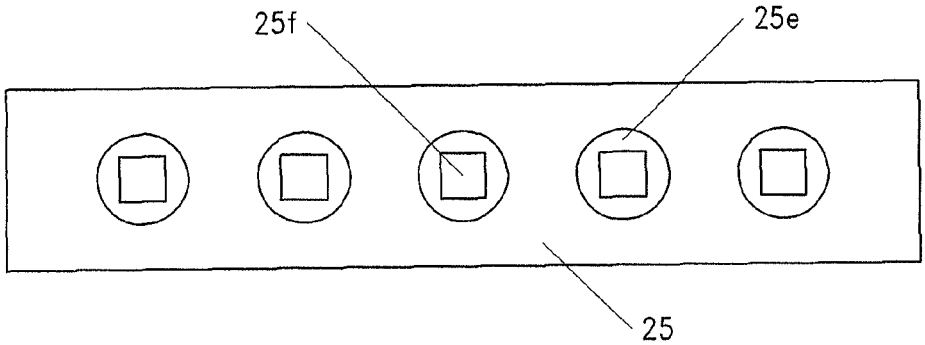
FIG. 11 shows a bottom view of the floating grip according to aspects of the invention.

FIG. 11 shows a bottom view of the floating grip 25 according to aspects of the invention. The bottom view shows the recesses 25*e* for receiving the springs 35. The bottom view also shows the openings 25*f* for receiving the pins 30. In embodiments, each recess 25*e* completely surrounds the pin, and can be circular in shape; although other shapes are also contemplated by the present invention. Likewise, the openings 25*f* can be square or circular to match the pin shaft 30*b* shape; although other shapes are also contemplated by the present invention.

Figure 12A:
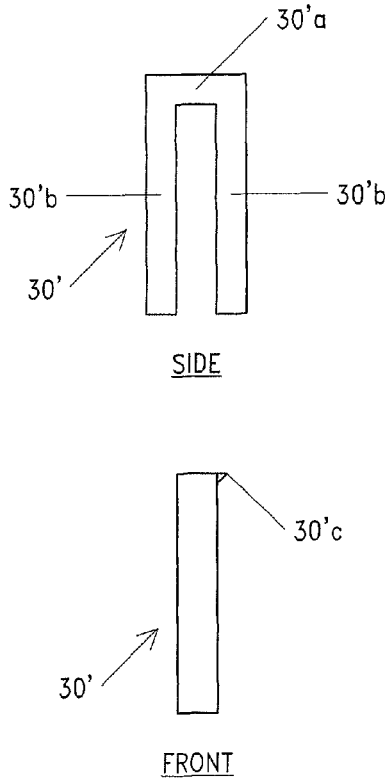
FIG. 12A shows a side view and a front view of an alternate pin according to aspects of the invention.

FIG. 12A shows a side view and a front view of an alternate pin 30' according to aspects of the invention. In particular, the pin 30' includes a pin head 30'*a*, two pin legs 30'*b*, and a projecting tip 30'*c*. The projecting tip 30'*c* is an extruding portion extending outward from the pin 30', in order to make contact with a cavity projection 25'*c* of the floating grip 25'. As discussed herein, the contact between the projecting tip 30'*c* and the cavity projection 25'*c* will result in a clicking noise which signifies the grip mechanism 17 is in a fully compressed state or a released or semi-released state, during usage.

Figure 12B:
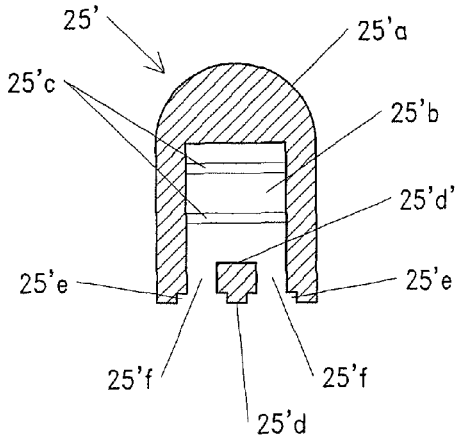
FIG. 12B shows a cross-sectional view (at the pin location) of an alternate floating grip used with the pin of FIG. 12A according to aspects of the invention.

FIG. 12B shows a cross-sectional view (at the pin 30' location) of an alternate floating grip 25' used with the pin 30' of FIG. 12A according to aspects of the invention. The floating grip 25' includes a floating grip body 25'*a* and a cavity 25'*b* for receiving the pin 30'. The cavity 25'*b* includes one or more cavity projections 25'*c* which communicate with the projecting tip 30'*c*. The floating grip body 25'*a* further includes a portion 25'*d* with an engagement surface 25'*d'*. The engagement surface 25'*d'* acts as a rest or stop for the pin head 30'*a* when the grip mechanism 17 is in a released state. The floating grip body 25'*a* also includes one or more openings 25'*f* for accommodating the pin legs 30'*b*. The openings 25'*f* are surrounded by the recesses 25'*e* which accommodate the springs 35.

Similar to the pervious embodiment, in use, as the pin head 30'*a* slides within the cavity 25'*b*, the projecting tip 30'*c* contacts the cavity projection 25'*c* causing a clicking sound. The engagement 25'*d* will prevent the pin 30' from sliding out of the floating grip 25' when the grip mechanism 17 is released. In this state, the pin head 30'*a* rests on top of the surface of the engagement surface 25'*d'*.

Figure 13A:
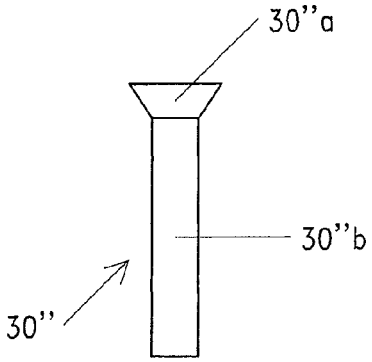
FIG. 13A shows a side view (front view is identical to side view) of an alternate pin according to aspects of the invention.

FIG. 13A shows a side view (front view is identical to side view) of an alternate pin 30" according to aspects of the invention. In particular, the pin 30" includes a tapered pin head 30"*a* and a pin shaft 30"*b*. The tapered pin head 30"*a* can be, for example, circular; although other shapes are also contemplated by the present invention. The tapered pin head 30"*a* is projecting outward in order to make contact with a cavity projection 25"*c* of the floating grip 25". As discussed herein, the contact between the tapered pin head 30"*a* and the cavity projection 25"*c* will result in a clicking noise which signifies the grip mechanism 17 is in a fully compressed state or a released or semi-released state, during usage.

Figure 13B:
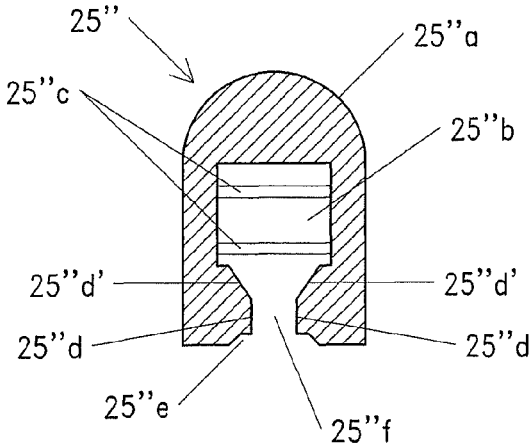
FIG. 13B shows a cross-sectional view (at the pin location) of an alternate floating grip used with the pin of FIG. 13A according to aspects of the invention.

FIG. 13B shows a cross-sectional view (at the pin 30" location) of an alternate floating grip 25" used with the pin 30" of FIG. 13A according to aspects of the invention. The floating grip 25" includes a floating grip body 25"*a* and a cavity 25"*b* for receiving the pin 30". The cavity 25"*b* includes one or more cavity projections 25"*c* which communicate with the tapered pin head 30"*a*. The floating grip body 25"*a* further includes a lip 25"*d* with a lip surface 25"*d'*. The lip surface 25"*d'* acts as a rest or stop for the pin head 30"*a* when the grip mechanism 17 is in a released state. The floating grip body 25"*a* also includes an opening 25"*f* for accommodating the pin shaft 30"*b*. The opening 25"*f* is surrounded by the recess 25"*e* which accommodates the spring 35.

The foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus comprising:
a handle; and
a grip mechanism comprising:
a swivel grip rotatably attached to the handle;
a floating grip coupled to the swivel grip by one or more pins; and
one or more springs between the swivel grip and the floating grip,
wherein the handle comprises one or more eyelets.

2. The apparatus of claim 1, wherein the swivel grip is coupled to the handle by a removable connecting mechanism through a longitudinal bore of the swivel grip, wherein the grip mechanism is removable from the handle.

3. The apparatus of claim 1, wherein one or more of the pins are integral to the swivel grip.

4. The apparatus of claim 1, wherein the one or more springs surround the one or more pins, the one or more springs separating the floating grip from the swivel grip.

5. An apparatus comprising:
a handle; and
a grip mechanism comprising:
a swivel grip rotatably attached to the handle;
a floating grip coupled to the swivel grip by one or more pins; and
one or more springs between the swivel grip and the floating grip,
wherein the swivel grip and floating grip comprise one or more recesses for accommodating the one or more springs.

6. An apparatus comprising:
a handle; and
a grip mechanism comprising:
a swivel grip rotatably attached to the handle;
a floating grip coupled to the swivel grip by one or more pins; and
one or more springs between the swivel grip and the floating grip, wherein the floating grip comprises one or more cavities that are structured to accommodate a pin head of each of the one or more pins.

7. The apparatus of claim 6, wherein:
the one or more cavities comprises one or more cavity projections structured to accommodate one or more pin head projections, thereby creating lips within the floating grip which prevent the one or more pins from escaping the one or more cavities when the grip mechanism is in a non-compressed state; and
the one or more pin heads comprises the one or more pin head projections for communicating with the cavity projections.

8. The apparatus of claim 7, wherein:
the one or more pins comprises one or more tapered projections structured to create a clicking noise when in contact with cavity clicking projections or indentations; and
the one or more cavities comprises the one or more cavity clicking projections or indentations structured to create a clicking noise when in contact with the tapered projections.

9. An apparatus comprising:

a handle comprising one or more eyelets;

a grip mechanism comprising:

a swivel grip rotatably attached to the handle, the swivel grip comprising:

one or more recesses for accommodating one or more springs; and one or more pins integral to the swivel grip;

a floating grip coupled to the swivel grip by the one or more pins, the floating grip comprising one or more recesses for accommodating the one or more springs; and the one or more springs between the swivel grip and the floating grip, surrounding the one or more pins and seated within a respective recess of the one or more recesses of the swivel grip and the floating grip.

10. The apparatus of claim 9, wherein the swivel grip is coupled to the handle by a removable connecting mechanism through a longitudinal bore of the swivel grip, wherein the grip mechanism is removable from the handle.

11. The apparatus of claim 9, wherein the floating grip comprises one or more cavities that are structured to accommodate a pin head of each of the one or more pins.

12. The apparatus of claim 11, wherein:

the one or more cavities comprises one or more cavity projections structured to accommodate one or more pin head projections, thereby creating lips within the floating grip which prevent the one or more pins from escaping the one or more cavities when the grip mechanism is in a non-compressed state; and the one or more pin heads comprises the one or more pin head projections for communicating with the cavity projections.

13. The apparatus of claim 12, wherein:

the one or more pins comprises one or more tapered projections structured to create a clicking noise when in contact with cavity clicking projections or indentations; and the one or more cavities comprises the one or more cavity clicking projections or indentations structured to create a clicking noise when in contact with the tapered projections.

14. An apparatus comprising:

a handle comprising one or more eyelets;

a grip mechanism comprising:

a swivel grip rotatably attached to the handle, the swivel grip comprising:

one or more recesses for accommodating one or more springs; and one or more pins integral to the swivel grip, wherein one or more pin heads comprises one or more pin head projections for communicating with cavity projections, the one or more pins comprising one or more tapered projections structured to create a clicking noise when in contact with cavity clicking projections or indentations;

a floating grip coupled to the swivel grip by the one or more pins, the floating grip comprising:

one or more recesses for accommodating the one or more springs; and one or more cavities that are structured to accommodate a pin head of each of the one or more pins, wherein the one or more cavities comprises one or more cavity projections structured to accommodate the one or more pin head projections, thereby creating lips within the floating grip which prevent the one or more pins from escaping the one or more cavities when the grip mechanism is in a non-compressed state, the one or more cavities comprising one or more of the cavity clicking projections or indentations structured to create a clicking noise when in contact with the tapered projections; and the one or more springs between the swivel grip and the floating grip, surrounding the one or more pins and seated within a respective recess of the one or more recesses of the swivel grip and the floating grip.

15. The apparatus of claim 14, wherein the swivel grip is coupled to the handle by a removable connecting mechanism through a longitudinal bore of the swivel grip, wherein the grip mechanism is removable from the handle.

16. The apparatus of claim 5, wherein the swivel grip is rotatably attached to the handle through a longitudinal axis of the swivel grip.

17. The apparatus of claim 5, wherein the one or more springs separate the floating grip from the swivel grip by means of compression of the one or more springs.

18. The apparatus of claim 6, wherein the swivel grip is rotatably attached to the handle through a longitudinal axis of the swivel grip.

19. The apparatus of claim 6, wherein the one or more springs separate the floating grip from the swivel grip by means of compression of the one or more springs.

* * * * *